US005593281A

United States Patent [19]

Tai

[11] Patent Number: 5,593,281

[45] Date of Patent: Jan. 14, 1997

[54] DYNAMIC BALANCING APPARATUS FOR CEILING FANS

[75] Inventor: Jen-Lung D. Tai, 5616 W. Aster Dr., Glendale, Ariz. 85304

[73] Assignees: Jen-Lung D. Tai; Sandy H. Tai; Avon Tai; Rose Tai, all of Glendale, Ariz.

[21] Appl. No.: 538,007

[22] Filed: Oct. 2, 1995

[51] Int. Cl.[6] ..... F04D 29/66

[52] U.S. Cl. ..... 416/145; 416/5

[58] Field of Search ..... 416/5, 144, 145, 416/210 R, 219 A, 220 A, 500; 417/423.7, 424.1, 423.14; 74/573 R, 573 F; 310/51

[56] References Cited

U.S. PATENT DOCUMENTS

| | | | |
|---|---|---|---|
| 110,247 | 12/1870 | Kitson | 74/573 R |
| 4,621,977 | 11/1986 | Markwardt | 416/5 |
| 5,256,037 | 10/1993 | Chatelain | 416/5 |
| 5,380,156 | 1/1995 | Iacovino | 416/5 |

*Primary Examiner*—Edward K. Look
*Assistant Examiner*—Christopher Verdier
*Attorney, Agent, or Firm*—Scott J. Anchell

[57] ABSTRACT

A dynamic balancing apparatus including an annular chase enclosing at least one weight for automatically and continuously eliminating rotational imbalance in ceiling fans.

11 Claims, 5 Drawing Sheets

FIG. 6
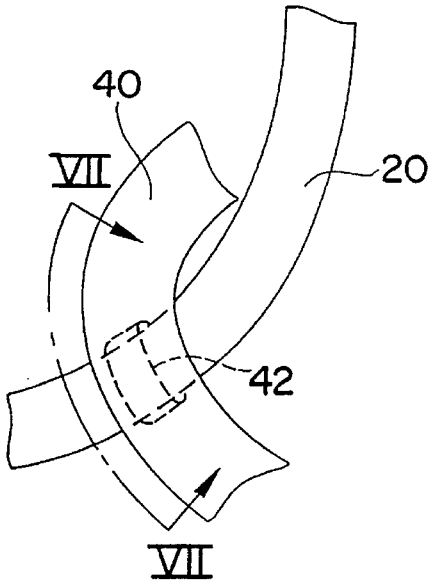
FIG. 7
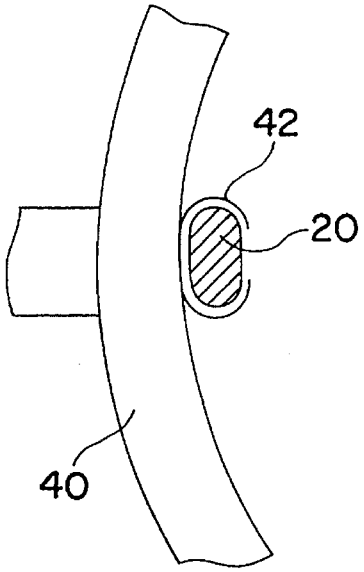
FIG. 8
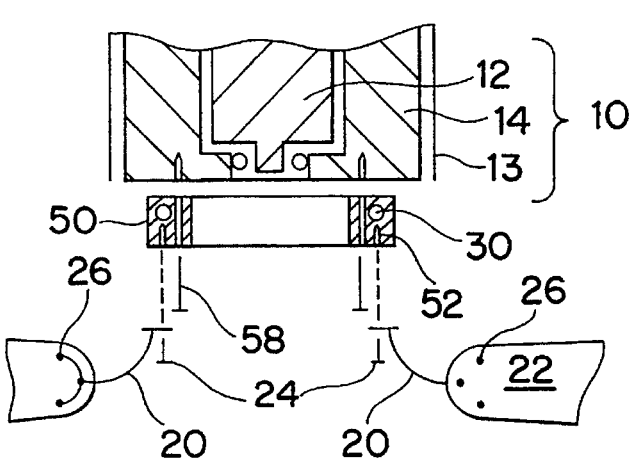
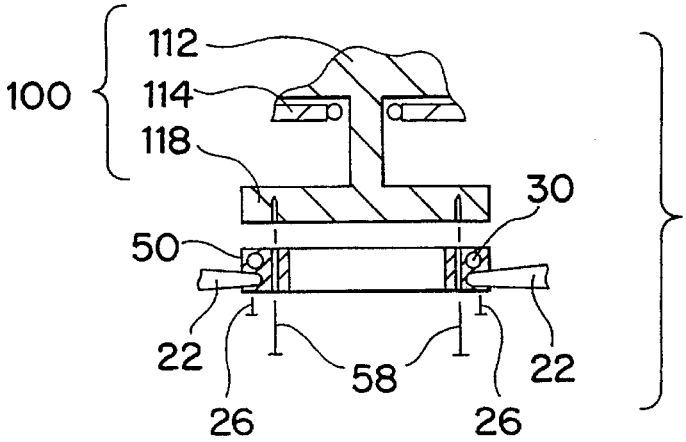
FIG. 9

FIG. 10
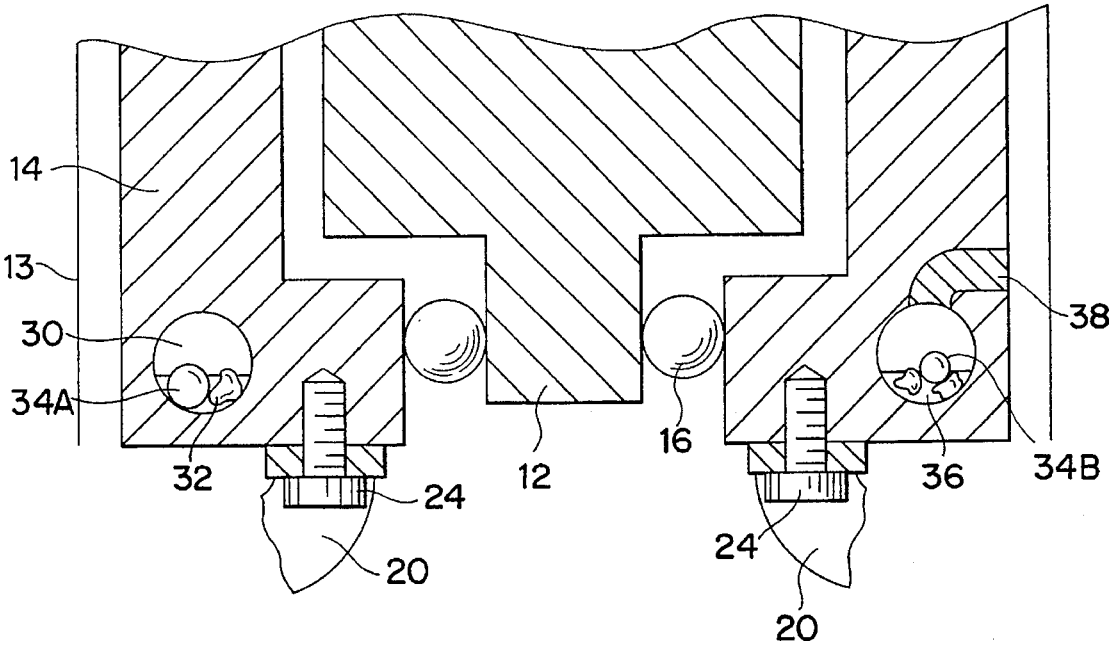
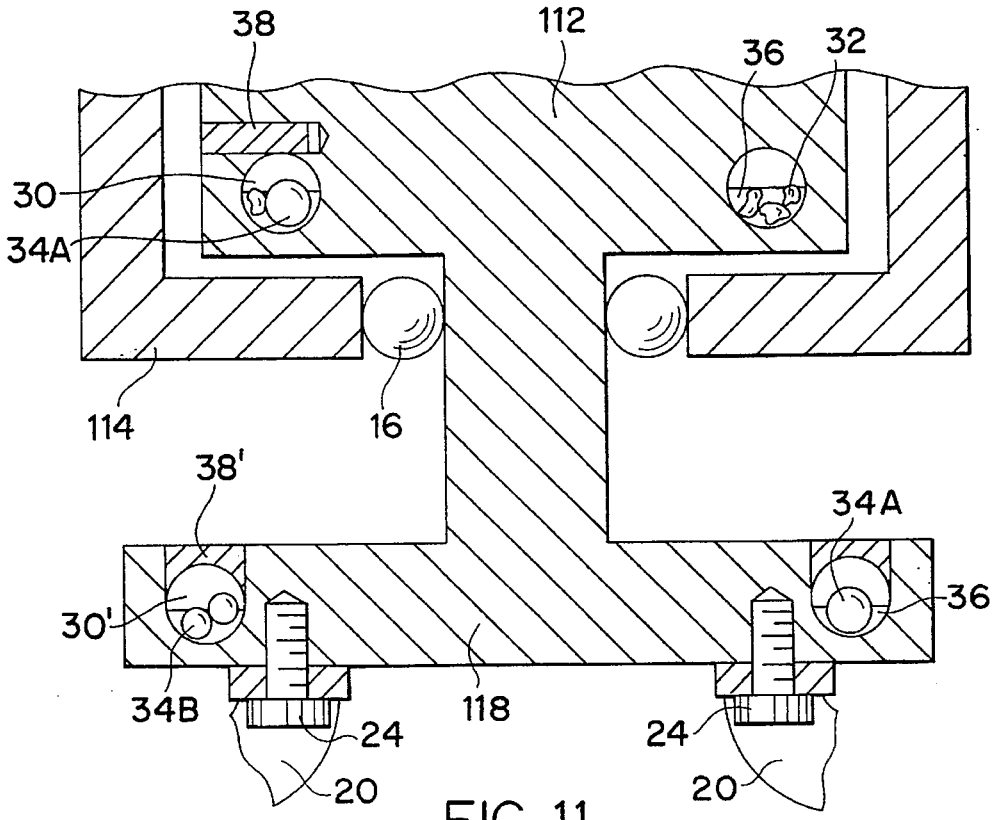
FIG. 11

DYNAMIC BALANCING APPARATUS FOR CEILING FANS

BACKGROUND OF THE INVENTION

1. Field of the Invention

The present invention concerns a universally applicable apparatus for dynamically balancing all known ceiling fans. Known ceiling fans may be described as having one of two configurations of drive motor arrangements: "spinner" and "flywheel".

According to the known spinner motor arrangement, the rotor of an alternating current (AC) electric motor is held stationary with respect to the ceiling, whereas the stator of the AC motor supports and turns with the fan blades. According to the known flywheel motor arrangement, the stator of an AC motor is held stationary with respect to the ceiling, whereas the rotor of the AC motor turns a flywheel which supports and turns the fan blades.

Generally, the mass of the stator (spinner motor arrangement) or the flywheel (flywheel motor arrangement) is exploited in an attempt to resist the tendency of the known ceiling fans to "wobble". Specifically, bearing sets between the rotors and stators facilitate relative rotation whereas the tendency of the rotating body to move laterally as a consequence of rotational imbalance is resisted by the mass of the rotating body.

It is important to minimize wobble for both aesthetic and functional reasons. From an aesthetic perspective, it is both audibly and visually distracting when a ceiling fan wobbles. From a functional perspective, wobble is dangerous. In particular, wobble causes vibration which reduces the service life of the bearing sets, loosens electrical and mechanical connections, and substantially increases the potential of structural failure of the ceiling fan mounting system.

Wobble also induces undesirable cyclical stress in the blade holders which extend between the fan blades and the rotating body. Eventually, this cyclical stress will result in fracture of the blade holders. This is particularly the case when the blade holders are improperly constructed (e.g. fabricated from unauthorized recycled materials, improper casting temperature, excessive pitch, etc.).

2. Description of Related Art

It is known in the prior art to construct the flywheel out of rubber which enables the fan blades in a flywheel motor arrangement ceiling fan to move up and down thereby minimizing imbalance of the rotating body. A disadvantage of rubber flywheel construction is the tendency to structurally fail after a period of use.

A "balancing kit" is also known in the prior art. The balancing kit consists of a testing clip and a number of self-adhesive weights. Essentially, a ceiling fan is balanced by a trial-and-error procedure wherein the testing clip is temporarily fixed along the length of a stationary fan blade. When the proper location for the weight(s) is finally determined with the testing clip, the weight(s) are adhered to the fan blade. Disadvantages of the balance kit include the extensive time necessary to determine the proper location for the weight(s), the potential of the adhesive to deteriorate and the weight(s) to be centrifugally thrown from the rotating ceiling fan, statically balancing a dynamic device, and the unsightly appearance of the weight(s) on a fan blade.

SUMMARY OF THE INVENTION

An object of the present invention is to provide an apparatus which dynamically balances any ceiling fan. In particular, it is an object of the present invention to provide a universally applicable (i.e. applicable to all existing ceiling fan installations as well as all new ceiling fan designs) apparatus which continuously eliminates rotational imbalance while the ceiling fan is operating.

Another object of the present invention is to provide a dynamic balancing apparatus which readily attaches to, or in place of, the blade holders extending between the rotating body and the fan blades.

Yet another object of the present invention is to provide a balancing apparatus which is self actuating, i.e. it does not require adjustment or tuning beyond simple installation.

These and other objects and advantages of the present invention are described hereinafter with respect to the drawings.

BRIEF DESCRIPTION OF THE DRAWING

FIG. 6 is a perspective segment view of an installation of the first embodiment according to the present invention.

FIG. 7 is a cross-section view along line VII—VII in FIG. 6.

FIG. 8 is an exploded partial cross-section view of the second embodiment according to the present invention installed on a spinner motor arrangement.

FIG. 9 is an exploded partial cross-section view of the second embodiment according to the present invention installed on a flywheel motor arrangement.

FIG. 10 is a partial cross-section view of a third embodiment according to the present invention.

FIG. 11 is a partial cross-section view of an alternative to the third embodiment according to the present invention.

DESCRIPTION OF THE PREFERRED EMBODIMENT

Figure 1:
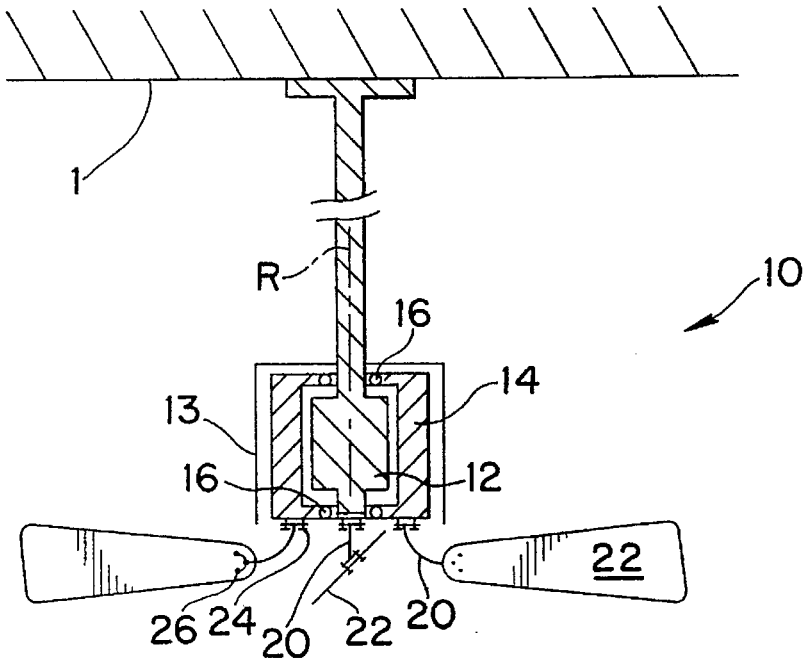
FIG. 1 (PRIOR ART)
FIG. 1 is a cross-section view illustrating a known spinner motor arrangement.

FIG. 1 shows the configuration of a known spinner motor arrangement for a ceiling fan 10. A rotor 12 and a decorative exterior casing 13 are secured with respect to a ceiling 1. A stator 14 is supported for relative rotation with respect to the rotor 12 by bearings 16. A plurality of fan blade holders 20 (three are illustrated in FIG. 1) extend from the stator 14 to respective fan blades 22. The fan blades 22 are "pitched" at an oblique angle in a known manner so as to displace air. At least one fastener 24 attaches each fan blade holder 20 to the stator 14, and at least one fastener 26 attaches each fan blade 22 to a respective fan blade holder 20. A triangular pattern of three fasteners 26 are illustrated in FIG. 1, however it is known to use different numbers and patterns of fasteners to attach fan blades to fan blade holders.

When the ceiling fan 10 is energized, a rotating magnetic field causes the stator 14, fan blade holders 20 and fan blades 22 to turn on an axis of rotation R with respect to rotor 12 and casing 13 in a known manner. Any rotational imbalance in the combination of stator 14, fan blade holders 20 and fan blades 22 will tend to cause undesirable lateral movement with respect to the axis of rotation R (i.e. wobble), and create vibration.

Figure 2:
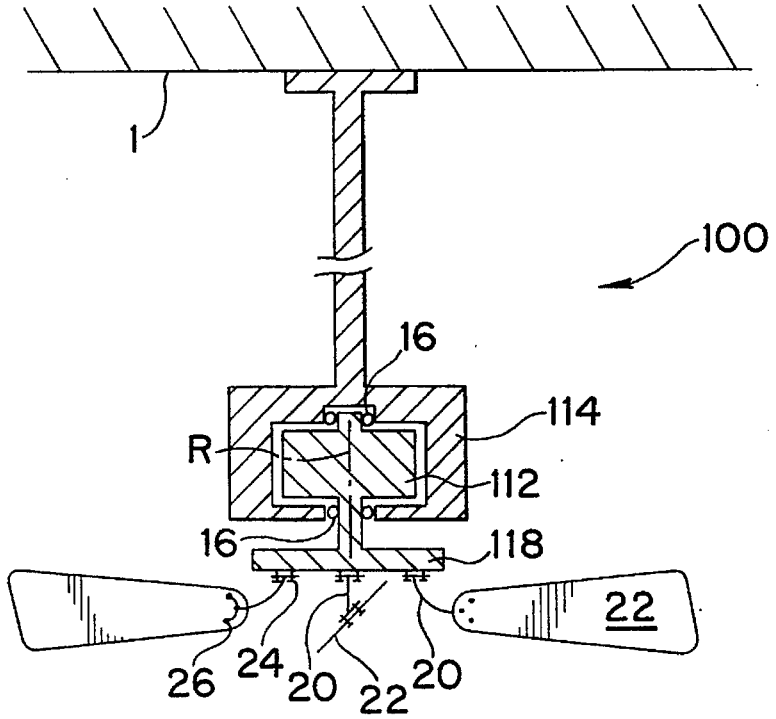
FIG. 2 (PRIOR ART)
FIG. 2 is a cross-section view illustrating a known flywheel motor arrangement.

FIG. 2 shows the configuration of a known flywheel motor arrangement for a ceiling fan 100. A stator 114 is secured with respect to a ceiling 1. A rotor 112 and a flywheel 118 are supported for relative rotation with respect to the stator 114 by bearings 16. The blade holders 20 extend from the flywheel 118 rather than the stator 14 in FIG. 1. Otherwise, the fan blades 22 and the fan blade holders 20 are attached by fasteners 24,26 in the same manner as that described with respect to FIG. 1.

When the ceiling fan 100 is energized, a rotating magnetic field causes the rotor 112, fan blade holders 20 and fan blades 22 to turn on an axis of rotation R with respect to stator 114 in a known manner. Again, any rotational imbalance in the combination of rotor 112, fan blade holders 20 and fan blades 22 will tend to cause undesirable lateral movement with respect to the axis of rotation R (i.e. wobble), and create vibration.

Figure 3:
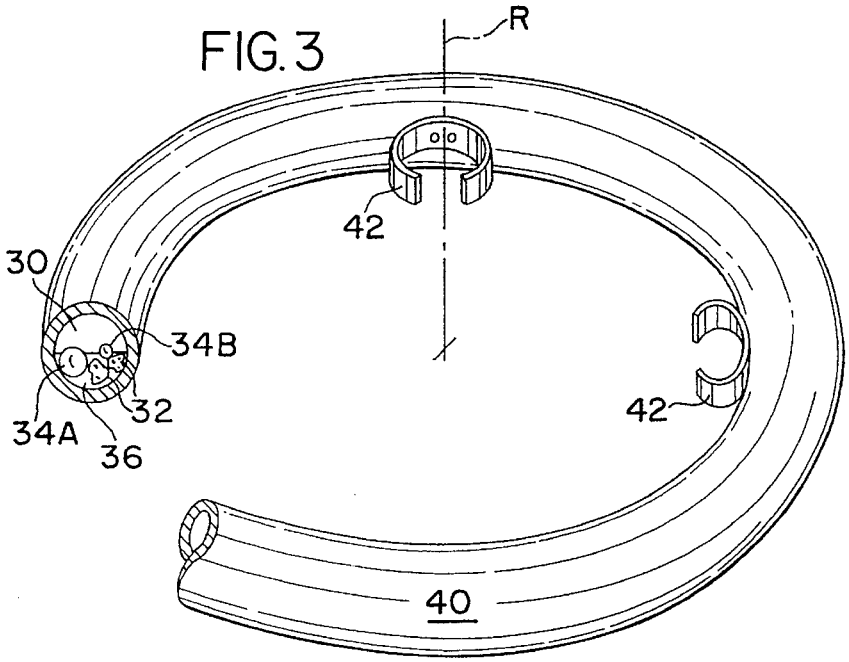
FIG. 3 is a partial cross-section, perspective view of a first embodiment according to the present invention.

According to a first embodiment of the present invention depicted in FIG. 3, an annular chase 30 is formed by a hollow circular member 40. Included within the annular chase 30 are one or more weights. The weights may include random pieces of material 32 (e.g. metal shavings, ceramic chips, bits of rubber, etc.), large uniformly shaped pieces 34A (e.g. spheres), small uniformly shaped pieces 34B, and/or a fluid 36. One or more types of weights 32,34,36 may be included provided it is possible for weight to be freely distributed within the circumference of annular chase 30. In particular, the weight(s) 32,34,36 are distributed by centrifugal force as the annular chase 30 turns about the axis of rotation R. The distribution of weight(s) 32,34,36 inherently counteracts any rotational imbalance by automatically shifting an additional amount of weight equal to and diametrically opposite with respect to any relatively heavy portions of the rotating body. The theory of placing additional weight to compensate for rotational imbalance is comparable with that of balancing a tire. The solid weights 32,34 may also be coated to reduce noise.

Clips 42 enable the hollow circular member 40 to be attached to fan blade holders 20. The number and arrangement of clips 42 (two are illustrated in FIG. 3) around the circumference of the hollow circular member 40 is selected to be consistent with the number and position of the fan blade holders 20. The clips may be securely attached (i.e. by welding, threaded fasteners, etc.) to the hollow circular member 40, or clips 42 may loosely grip both of the hollow circular member 40 and fan blade holders 20. In either event, the clips should extend around a majority of the element(s) gripped to ensure the hollow circular member 40 is positively positioned with respect to the fan blade holders 20. Further, cross-sectional profile may be selected for hollow circular member 40 (a circular cross-sectional profile is illustrated in FIG. 3), and the clips 42 may be located at any position around the cross-sectional periphery of hollow circular member 40.

Figure 4:
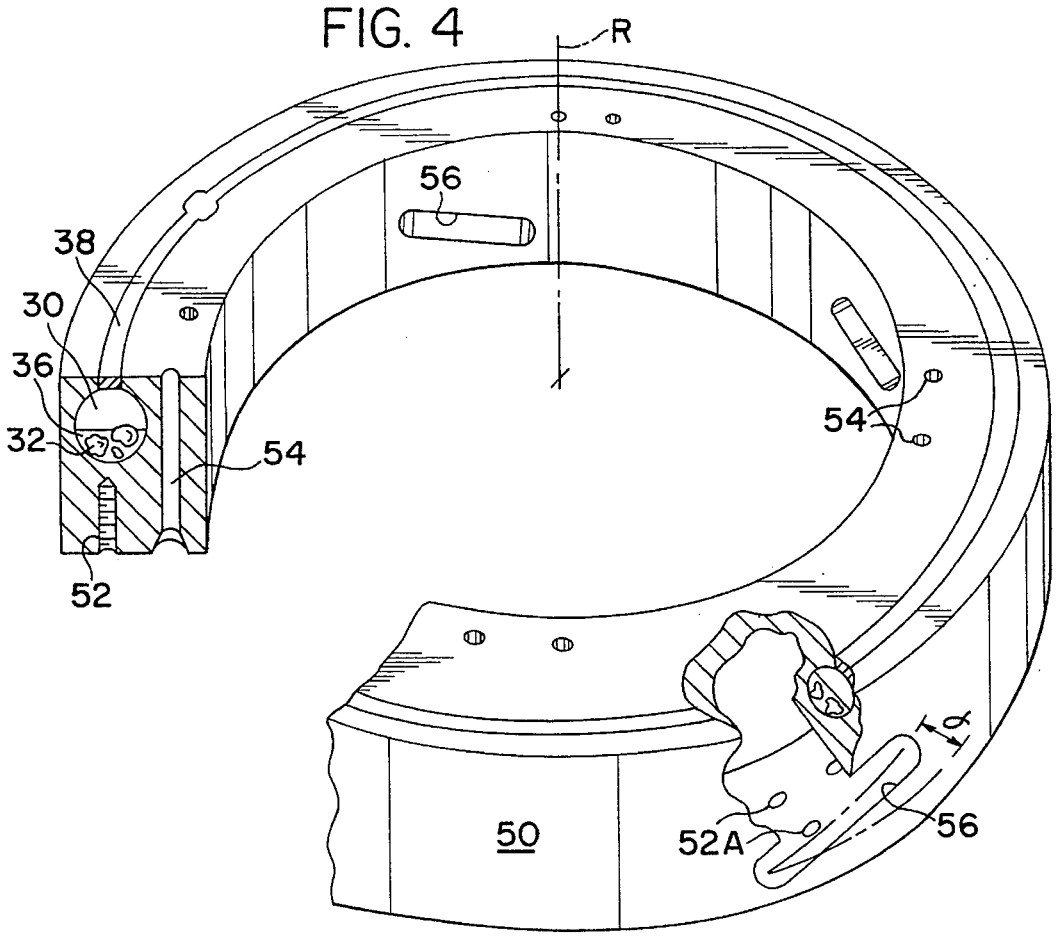
FIG. 4 is a partial cross-section, perspective view of a second embodiment according to the present invention.

FIG. 4 illustrates an alternative design of the present invention which does not use clips 42. In particular, a unitary ring 50 is created with a similar annular chase 30 filed with weight(s) 32,34,36 (only weights 32 and 36 are illustrated in FIG. 4). The annular chase 30 may be closed with any appropriately sized and shaped plug 38. The function of the annular chase 30 and weight(s) 32,34,36 is identical to that described with respect to FIG. 3.

The unitary ring 50 may be designed to be interposed between the rotating body (i.e. stator 14 illustrated in FIG. 1, or flywheel 118 illustrated in FIG. 2) and the fan blade holders 20, and/or the unitary ring 50 may be installed in place of the fan blade holders 20.

In the former design, a plurality first attachment holes 52 (only one is illustrated in FIG. 4) are adapted to receive fasteners 24 thereby fixing the unitary ring 50 with respect to the fan blades 22 via the fan blade holders 20. A plurality of second attachment holes 54 (eight are illustrated in FIG. 4) are used to fix unitary ring 50 with respect to the rotating body. It is noted that the number and pattern of first and second attachments 52,54 may be selected so as to be consistent with any manner of fixing the fan blade holders 20 directly to the rotating body.

According to the latter design of the unitary ring 50, the fan blade holders 20 are eliminated after being separated from the rotating body and the fan blades 22. As in the former design, the unitary ring 50 is fixed with respect to the rotating body by second attachment holes 54. However, each fan blade 22 is inserted into a respective slot 56 (three are illustrated in FIG. 4) and first attachment holes 52A (three are illustrated in FIG. 4) are adapted to receive second fasteners 26 thereby fixing the unitary ring 50 with respect to the fan blades 22. The slots 56 are oriented at an oblique angle a so as to maintain the correct pitch of the fan blades 22. Although the slots 56 are depicted as extending from the outer diameter of the unitary ring 50 through to the inner diameter of the unitary ring 50, it is not necessary for the slots 56 to extend entirely through the unitary ring 50. As with the first attachments 52, the number and pattern of first attachments 52A may be selected so as to be consistent with any manner of fixing the fan blade holders 20 directly to the fan blade holders 20.

Figure 5:
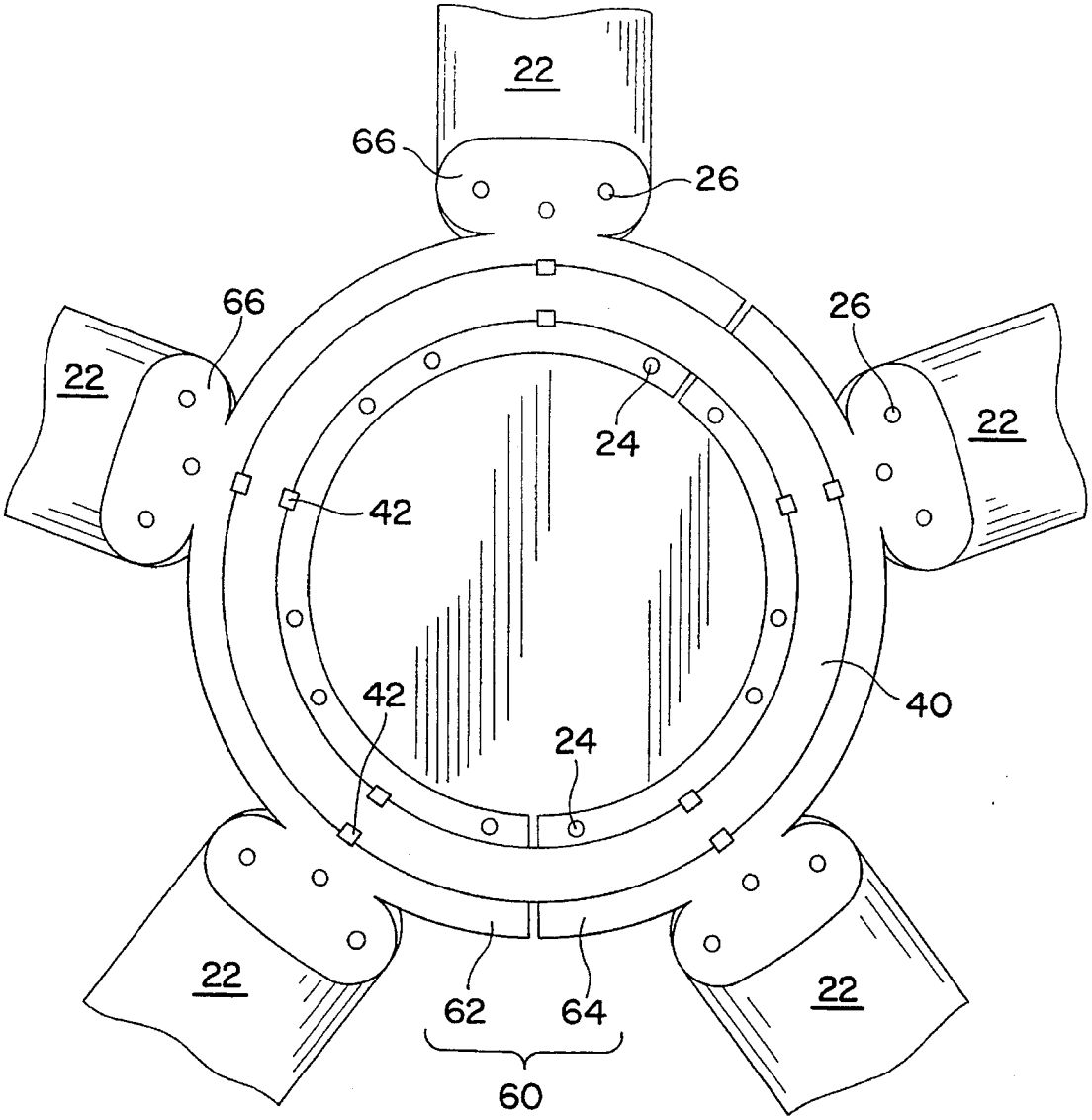
FIG. 5 is a top view of an alternative to the second embodiment according to the present invention.

The unitary ring 50 has been depicted as being formed as a single molding, however, FIG. 5 shows it is equally appropriate for a dynamic balancing apparatus 60 to be assembled as a composite of stamped or otherwise formed pieces. As illustrated, the dynamic balancing apparatus 60 includes two arcuate sections 62,64 which complement one another (dynamic balancing apparatus 60 may alternatively be composed of only one or more than two pieces). Extending from the arcuate sections 62,64 are fan blade holders 66. Fasteners 24 and 26 attach the dynamic balancing apparatus 60 to a motor arrangement and the fan blades 22, respectively. A hollow circular member 40 as discussed above is secured to the arcuate sections 62,64 by clips 42.

FIGS. 6 and 7 illustrate the installation of hollow circular member 40 with respect to a fan blade holder 20. As described above, the clip 42, which is secured to the hollow circular member 40, surrounds a majority of the fan blade holder 20.

FIG. 8 illustrates the installation of the first design of unitary ring 50 on a spinner motor arrangement of a ceiling fan 10 (it is noted that the first design of the unitary ring 50 may equally be installed on a flywheel motor arrangement of a ceiling fan 100). Fasteners 24 are removed such that the existing fan blade holder 20 and fan blade 22 assemblies are disconnected from stator 14, and the unitary ring 50 is interposed therebetween. Fasteners 58 are supplied to fix the unitary ring 50 with respect to the stator 14, and fasteners 24 are used to fix the aforementioned assemblies to the unitary ring 50.

FIG. 9 illustrates the installation of the second design of unitary ring 50 on a flywheel motor arrangement of a ceiling fan 100 (it is noted that the second design of the unitary ring 50 may equally be installed on a spinner motor arrangement of a ceiling fan 10). Fasteners 24 and 26 are removed such that the fan blade holders 20 can be eliminated. The unitary ring 50 is fixed to the flywheel 118 by fasteners 58 supplied with the unitary ring 50. Fan blades 22 are inserted into slots 56 in the unitary ring 50 and fasteners 26 are replaced in first attachment holes 52A to fix the fan blades 22 with respect to the unitary ring 50.

According to a third embodiment of the present invention depicted in FIG. 10, an annular chase 30 is formed directly in the stator 14 of a spinner motor arrangement. Again, weight(s) 32,34,36 are included within the annular chase 30 which may be enclosed with a plug 38. All other aspects of the spinner motor arrangement and dynamic balancing apparatus have been described previously.

An alternative to the third embodiment of the present invention is depicted in FIG. 11. Specifically, an annular chase 30 may be similarly formed directly in the rotor 112 of a flywheel motor arrangement, or an annular chase 30' may be formed directly in the flywheel 118 of the flywheel motor arrangement. Again, weight(s) 32,34,36 are included within the annular chase 30,30' which may be enclosed with a plug 38,38'. All other aspects of the flywheel motor arrangement and dynamic balancing apparatus have been described previously.

The essence of the invention is to adapt a dynamic balancing apparatus 40,50 to previously installed ceiling fans (FIGS. 6–9) or new ceiling fan constructions (FIGS. 10 and 11), thereby ensuring the ceiling fans are automatically and continuously balanced, and undesirable wobble is eliminated.

What is claimed is:

1. A dynamic balancing apparatus for a ceiling fan, wherein the ceiling fan includes a body turning on an axis of rotation and a plurality of fan blades, said balancing apparatus comprising:

first attachment means for operably interposing and fixing said balancing apparatus between the body and the fan blades;

second attachment means for securing said balancing apparatus to the body;

an annular chase concentrically surrounding the axis of rotation, said annular chase lies in a plane orthogonally oriented with respect to the axis of rotation; and, weight means for counteracting rotational imbalance of the ceiling fan, said weight means is centrifugally distributed within said annular chase.

2. Said dynamic balancing apparatus according to claim 1, wherein said weight means comprises a fluid.

3. Said dynamic balancing apparatus according to claim 2, wherein said weight means further comprises a plurality of metal elements.

4. Said dynamic balancing apparatus according to claim 1, wherein said weight means comprise a plurality of metal elements.

5. Said dynamic balancing apparatus according to claim 4, wherein each of said plurality of metal elements have a uniform shape.

6. Said dynamic balancing apparatus according to claim 5, wherein each of said plurality of metal elements have a uniform size.

7. Said dynamic balancing apparatus according to claim 4, wherein each of said plurality of metal elements have a random shape and a random size.

8. Said dynamic balancing apparatus according to claim 1, wherein said annular chase is formed in the body, and said first attachment means comprise blade holders extending between the body and each of the plurality of fan blades.

9. A dynamic balancing apparatus for a ceiling fan, wherein the ceiling fan includes a body turning on an axis of rotation and a plurality of fan blades, said balancing apparatus comprising:

first attachment means for fixing said balancing apparatus with respect to the fan blades;

an annular chase concentrically surrounding the axis of rotation, said annular chase lies in a plane orthogonally oriented with respect to the axis of rotation; and weight means for counteracting rotational imbalance of the ceiling fan, said weight means is centrifugally distributed within said annular chase;

wherein said first attachment means comprise a plurality of slots obliquely oriented with respect to said plane, each of said plurality of slots receives a respective one of the plurality of fan blades.

10. Said dynamic balancing apparatus according to claim 9, wherein said first attachment means further comprises at least one fastener extending across a respective one of said plurality of slots and extending through a respective one of the plurality of fan blades.

11. Said dynamic balancing apparatus according to claim 10, wherein said first attachment means yet further comprises groups of said fasteners extending across each of said respective ones of said plurality of slots and extending through a respective one of the plurality of fan blades.

* * * * *